US006220528B1

(12) United States Patent
Cooke et al.

(10) Patent No.: US 6,220,528 B1
(45) Date of Patent: Apr. 24, 2001

(54) FUEL INJECTOR INCLUDING AN OUTER VALVE NEEDLE, AND INNER VALVE NEEDLE SLIDABLE WITHIN A BORE FORMED IN THE OUTER VALVE NEEDLE

(75) Inventors: Michael Peter Cooke, Gillingham; Godfrey Greeves, Hatch End, both of (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/324,621

(22) Filed: Jun. 2, 1999

(30) Foreign Application Priority Data

Jun. 24, 1998 (GB) ..... 9813476

(51) Int. Cl.[7] ..... B05B 1/30
(52) U.S. Cl. ..... 239/533.3; 239/546; 239/585.5
(58) Field of Search ..... 239/533.1–533.4, 239/533.9, 533.11, 533.13, 585.5, 546

(56) References Cited

U.S. PATENT DOCUMENTS 3,913,537 * 10/1975 Ziesche et al. ..... 239/585.5 X
4,202,500 * 5/1980 Keiczek ..... 239/533.3
4,546,739 * 10/1985 Nakajima et al. ..... 239/533.4 X
4,570,853 * 2/1986 Schmied ..... 239/533.3 X
4,826,081 * 5/1989 Zwick ..... 239/533.11 X
5,458,292 * 10/1995 Hapeman ..... 239/533.4

* cited by examiner

*Primary Examiner*—James Hook
*Assistant Examiner*—Jorge Bocanegra
(74) *Attorney, Agent, or Firm*—Wells, St. John, Roberts Gregory & Matkin P.S.

(57) ABSTRACT

A fuel injector comprises an outer valve needle, an inner valve needle slidable within a bore formed in the outer valve needle, an inner end of the inner valve needle being located within the bore, the inner end of the inner valve needle being provided with a recess whereby the application of fuel under pressure to the bore deforms the inner valve needle to form a substantially fluid tight seal between the inner and outer valve needles. The inner and outer needles may be exposed to the fuel pressure within a common control chamber, a single actuator arrangement being used to control movement of both needles.

13 Claims, 2 Drawing Sheets

FUEL INJECTOR INCLUDING AN OUTER VALVE NEEDLE, AND INNER VALVE NEEDLE SLIDABLE WITHIN A BORE FORMED IN THE OUTER VALVE NEEDLE

TECHNICAL FIELD

This invention relates to a fuel injector for use in supplying fuel, under pressure, to a combustion space of a compression ignition internal combustion engine.

BACKGROUND OF THE INVENTION

In order to reduce emissions levels, it is known to provide fuel injectors in which the total area of the openings through which fuel is delivered can be varied, in use. One technique for achieving this is to use two valve needles, one of which is slidable within a bore provided in the other of the needles to control the supply of fuel to some of the outlet openings independently of the supply of fuel to others of the outlet openings.

Such arrangements have the disadvantages that fuel may be able to flow between the inner and outer needles giving rise to substantially continuous delivery of fuel at a low rate. Further in order to control the movement of the inner and outer needles, separate actuators may be required resulting in the injector being of increased complexity.

SUMMARY OF THE INVENTION

According to a first aspect of the invention there is provided a fuel injector comprising an outer valve needle, an inner valve needle slidable within a bore formed in the outer valve needle, an inner end of the inner valve needle being located within the bore, the inner end of the inner valve needle being provided with a recess whereby the application of fuel under pressure to the bore deforms the inner valve needle to form a substantially fluid tight seal between the inner and outer valve needles.

Such an arrangement is advantageous in that leakage and fuel delivery at undesirable points in the engine operating cycle can be reduced or avoided.

According to another aspect of the invention there is provided an injector comprising an outer valve needle and an inner valve needle, the inner needle being slidable within a bore formed in the outer needle, the inner and outer needles being exposed to the fuel pressure within a control chamber, and a single actuator controlling the fuel pressure within the control chamber.

The actuator may take the form of an electromagnetically actuated valve, or alternatively may comprise a piston moveable by a piezoelectric actuator.

Such an arrangement permits independent control of the inner and outer valve needles using a single actuator, movement of the inner and outer needles being dependent upon the pressure differential between the upper and lower ends thereof, the effective cross sectional areas exposed to fuel under pressure and the effect of any spring biasing.

BRIEF DESCRIPTION OF THE DRAWINGS

The invention will further be described, by way of example, with reference to the accompanying drawings, in which like reference numerals are used to denote like parts, and in which.

DETAILED DESCRIPTION OF THE PREFERRED EMBODIMENTS

Figure 1:
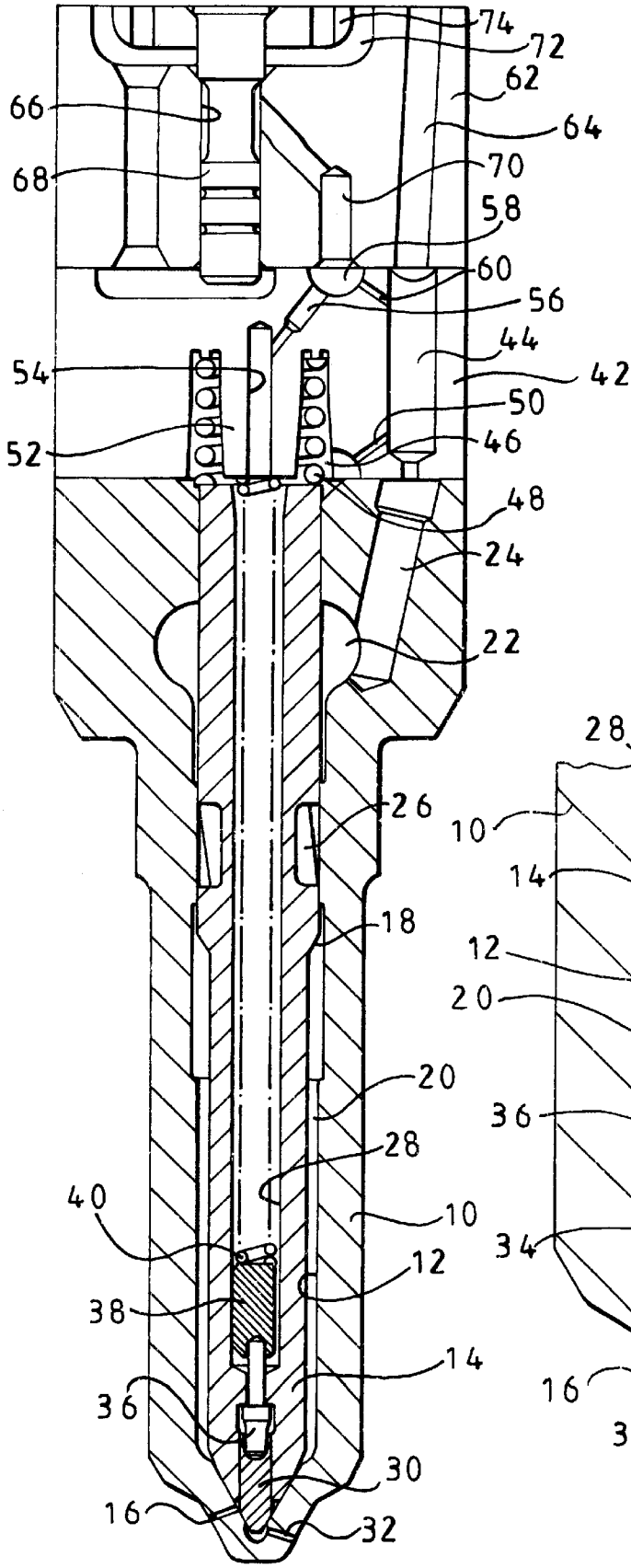
FIG. 1 is a sectional view of part of an injector in accordance with an embodiment.
Figure 2:
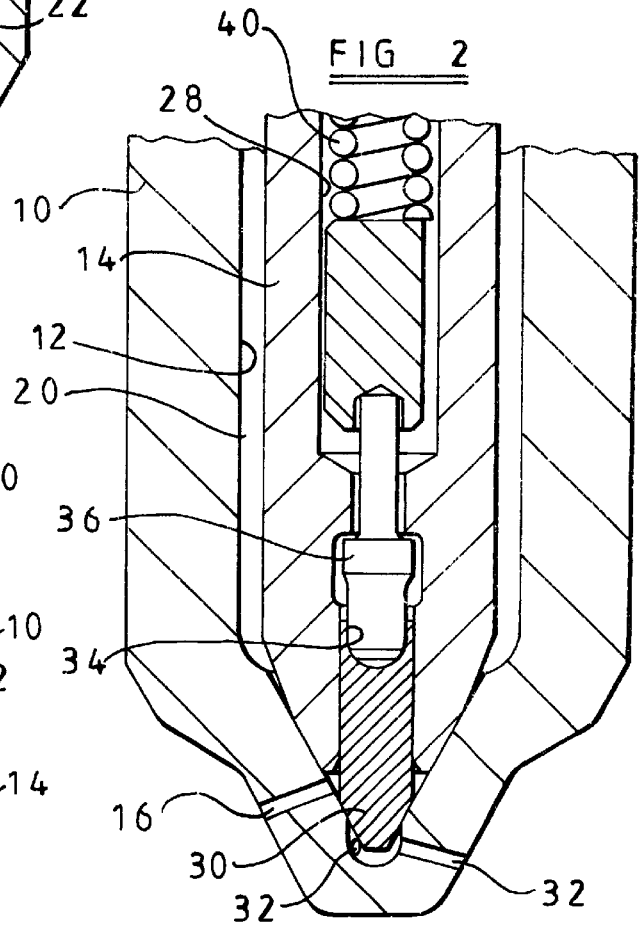
FIG. 2 is a view, to an enlarged scale, of part of the injector of FIG. 1.

The fuel injector illustrated in FIGS. 1 and 2 comprises a nozzle body 10 provided with a blind bore 12. Adjacent the blind end of the bore, the bore 12 is shaped to define a seating of substantially frusto-conical shape. An outer valve needle 14 is slidable within the bore 12, the outer valve needle 14 defining, adjacent its lower end, a region of substantially frusto-conical shape arranged to engage the frusto-conical seating to control the supply of fuel from the bore 12 to a first group of outlet openings 16.

The upper end of the outer valve needle 14 is shaped to be of diameter substantially equal to the diameter of the adjacent parts of the bore 12 to form a substantially fluid tight seal therewith and to guide the outer valve needle 14 for sliding movement in the bore 12. As illustrated in FIG. 1, the outer valve needle 14 further includes a lower region of smaller diameter, the relatively large diameter upper region and the lower, small diameter region together defining an angled thrust surface 18 which is exposed to the fuel pressure within a chamber 20 defined between the lower part of the outer valve needle 14 and the adjacent part of the bore 12. A part of the lower, conical end surface of the outer valve needle 14 is also exposed to the fuel pressure within the chamber 20.

The bore 12 defines an annular gallery 22 which communicates with a supply passage 24 which, in use, communicates with a source of fuel under pressure, for example a common rail charged with fuel by an appropriate fuel pump.

The outer valve needle 14 is provided with flutes 26 whereby fuel is able to flow from the annular gallery 22 to the chamber 20.

The outer valve needle 14 is provided with an axially extending bore 28, an inner valve needle 30 being slidable within the lower part of the bore 28. The inner valve needle 30 is shaped, at its lower end, to define a frusto-conical region which is engageable with a part of seating located closer to the lower end of the nozzle body 10 than the first group of openings 16. A second group of openings 32 communicate with the bore 12 downstream of the position at which the inner valve needle 30 engages the seating. It will be appreciated that the engagement between the inner valve needle 30 and the seating controls the supply of fuel under pressure to the second group of outlet openings 32.

As shown most clearly in FIG. 2, the upper end surface of the inner valve needle 30 is provided with a recess 34, the provision of the recess 34 resulting in the upper part of the inner valve needle 30 being of relatively small wall thickness. The recess 34 is conveniently formed using a low force machining technique, for example electric discharge or electrochemical machining. A load transmitting member 36 is received within the recess 34, the upper end of the member 36 engaging a shim 38, which in turn engages a helical compression spring 40. The load transmitting member 36 is shaped to permit fuel to flow into the recess 34 and to be engageable with a step or shoulder defined by part of the bore 28 to limit movement of the inner valve needle 30 relative to the outer valve needle 14.

At its upper end, the nozzle body 10 engages a distance piece 42, the distance piece 42 being provided with a drilling 44 whereby fuel under pressure from the fuel source is supplied to the supply passage 24. A flow restrictor is provided in the drilling 44.

The distance piece 42 is further provided with a recess of annular shape defining a control chamber 46, the upper part of the outer valve needle 14 being exposed to the fuel pressure within the control chamber 46. A spring 48 is located within the control chamber 46, the spring 48 engaging the upper surface of the outer valve needle 14 to bias the valve needle 14 into engagement with the seating. A small diameter drilling 50 provides a restricted flow path between the drilling 44 and the control chamber 46. It will be appreciated that, in use, the provision of the restrictor in the drilling 44 permits the formation of a pressure differential across the valve needles 14, 30.

Within the control chamber 46, the distance piece 42 defines a projection 52 provided with an axially extending passage 54. The spring 40 engages the lower end of the projection 52. The passage 54 communicates through a restricted passage 56 with a recess 58 formed in the upper surface of the distance piece 42, a further restricted passage 60 connecting the recess 58 to the drilling 44.

The upper end of the distance piece 42 engages a valve housing 62 provided with a drilling 64 communicating with the drilling 44. The valve housing 62 is further provided with a through bore 66 within which a valve member 68 is slidable, the valve member 68 including a region engageable with a seating to control communication between a passage 70 which communicates with the recess 58, and a chamber 72 which communicates, in use, with a low pressure drain reservoir. The valve member 68 is spring biased into engagement with its seating, and movement of the valve member 68 away from its seating is controlled by an electromagnetic actuator (not shown) which, in conjunction with an armature 74 carried by the valve member 68 can apply a force to the valve member 68 to lift the valve member 68 from its seating.

In use, with the supply passage 24 communicating with the source of fuel under high pressure, and with the actuator de-energized so that the valve member 68 engages its seating, the fuel pressure within the chamber 20 is relatively high, thus a force is applied to the valve needle 14 urging the valve needle 14 away from the seating. This force is countered by the action of the fuel under pressure within the control chamber 46 and the action of the spring 48 with the result that the lower end of the outer valve needle 14 engages the seating. As a result, it will be appreciated that fuel under pressure is unable to flow from the chamber 20 to a position downstream of the engagement of the outer valve needle 14 with the seating. Fuel is therefore unable to flow to either of the first or second groups of outlet openings 16, 32.

At this point in the operating cycle of the injector, it will be appreciated that the fuel pressure within the bore 28 of the outer valve needle 14 is high, thus the upper end of the inner valve needle 30 is exposed to fuel under high pressure. The action of the fuel under pressure upon the upper end surface of the inner valve needle 30 in combination with the action of the spring 40 maintains the inner valve needle 30 in engagement with the seating. The action of the fuel under pressure on the upper part of the inner valve needle 30, and in particular the action of the fuel under high pressure within the recess 34 acts to deform the upper part of the inner valve needle 30 to expand the outer diameter thereof, thus forming a substantially fluid tight seal between the inner and outer valve needles 30, 14.

In order to commence injection, the actuator is energized, and as a result the valve member 68 is lifted from its seating. Fuel is able to escape from the control chamber 46 through the passages 54, 56, the recess 58 and the passage 70 to the low pressure reservoir. The fuel pressure within the control chamber 46 applied to the upper surface of the outer valve needle 14 is therefore reduced, and a point will be reached beyond which the force urging the valve needle 14 away from its seating is sufficient to overcome the action of the spring 48 and the fuel pressure within the control chamber 46, and the outer valve needle 14 will lift away from the seating, thus permitting fuel to flow to the first group of outlet openings 16. The flow of fuel across the open end of the bore 28 maintains the fuel pressure within the bore 28 to which the upper end surface of the inner valve needle 30 is exposed at a relatively high pressure, thus although the outer valve needle 14 moves, the inner valve needle 30 remains in contact with the seating. As a result, it will be appreciated that fuel delivery occurs only through the first group of outlet openings 16, fuel not being delivered through the second group of outlet openings 32 at this time. Additionally, as the inner valve needle does not move, it can assist in guiding the movement of the outer needle.

Once the outer valve needle 14 has lifted to its fully opened position, the upper end thereof engages the projection 52, thus the flow of fuel from the control chamber 46 to the low pressure drain through the passage 54 is terminated. Fuel flows to the control chamber 46 through the restricted passage 50, thus the fuel pressure within the control chamber 46 rises. However, as, at this point in the injection cycle, the effective area over which fuel under pressure acts to urge the needle away from the seating is large, the increase in fuel pressure within the control chamber 46 does not result in movement of the needle 14 to terminate injection. As the flow of fuel from the control chamber 46 to the low pressure drain is terminated, the fuel pressure within the bore 28 starts to fall, reducing the deformation of the inner valve needle 30. Further, a point will be reached beyond which the fuel pressure acting upon the exposed part of the inner valve needle 30 is able to lift the inner valve needle 30 against the action of the spring 40 in combination with the remaining fuel pressure within the bore 28 to allow fuel injection through both the first group of outlet openings 16 and the second group of outlet openings 32. Movement of the inner valve needle 30 is limited by engagement between the member 36 and the step defined by the bore 28.

The fuel pressure within the control chamber 46 increases as the flow of fuel from the control chamber 46 to the low pressure drain is terminated. Increased fuel pressure within the control chamber 46 increases the downward force applied to the outer valve needle 14, thereby serving to urge the needle 14 into engagement with the seating. In addition, fuel under pressure within the bore 28 further increases the downward force applied to the outer valve needle 14. Fuel pressure within the control chamber 46 and within the bore 28 is increased to an extent sufficient to cause movement of the needle 14 into engagement with the seating to terminate injection through the first group of outlet openings 16.

It will be appreciated that the embodiment of FIGS. 1 and 2 has the advantages that a single actuator is used to control movement of both the outer valve needle 14 and the inner valve needle 30. Further, the escape of fuel between the inner and outer valve needles 30, 14 is reduced or avoided.

In the arrangement described hereinbefore, movement of the inner valve needle occurs only when the pressure of fuel applied to the injector exceeds a predetermined level and when the outer needle has reached its fully lifted position. By appropriate control of the injector, the total area of the outlet openings in use can be controlled to permit the duration of injection to be maintained at a relatively low level even under high engine speed or load conditions.

Figure 3:
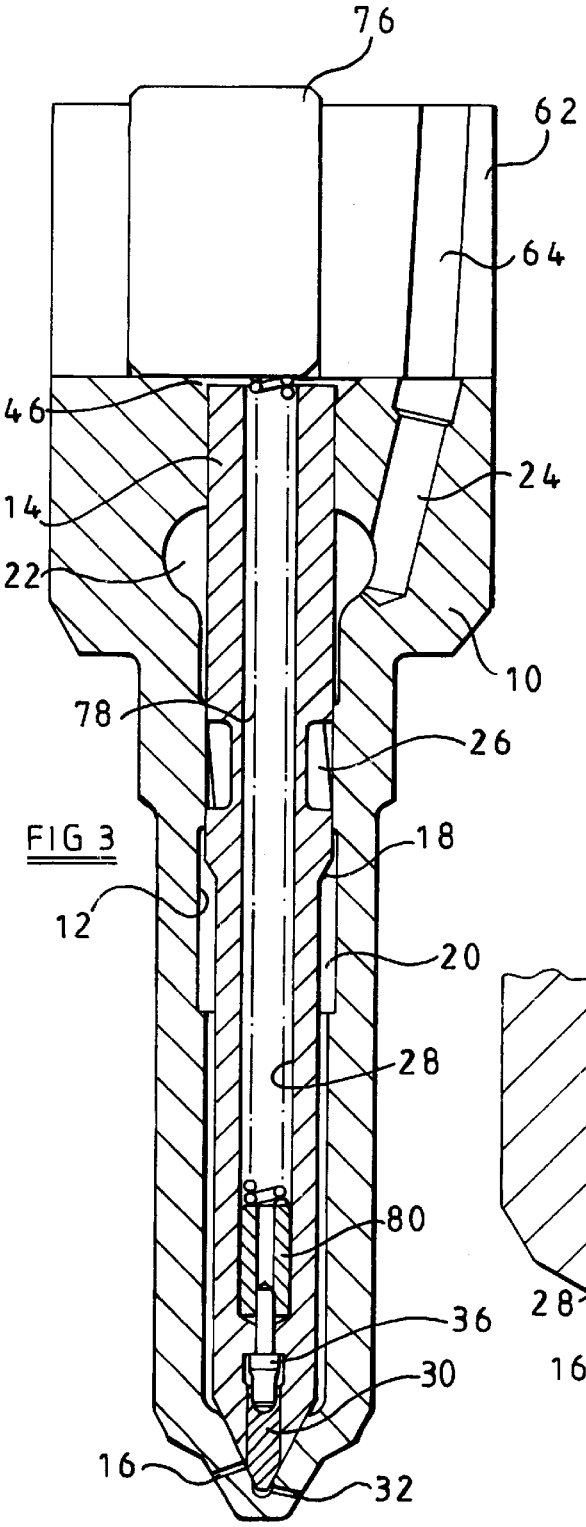
FIGS. 3 and 4 are views similar to FIGS. 1 and 2 illustrating an alternative embodiment.
Figure 4:
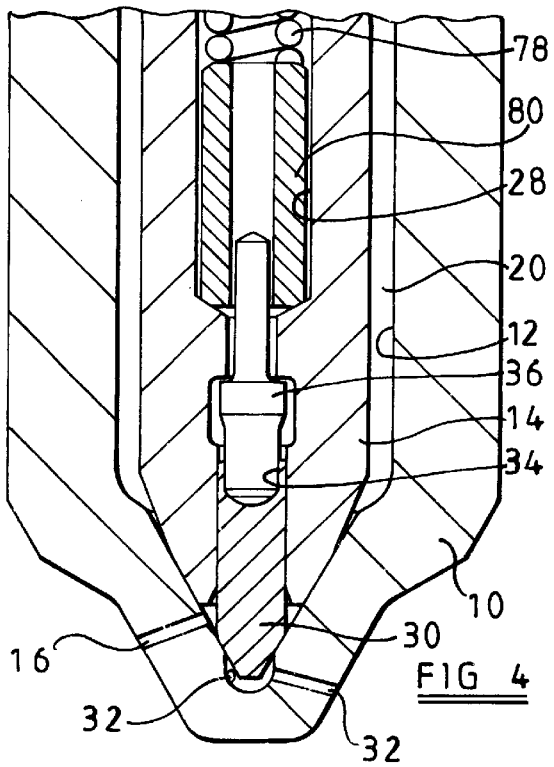

FIGS. 3 and 4 illustrate an arrangement which is similar to that of FIGS. 1 and 2, but in which the fuel pressure within the control chamber 46 is controlled using a piezoelectric actuator arrangement which controls the position of a piston 76. The inner and outer valve needles 30, 14 are both exposed, throughout the range of movement of outer valve needle 14, to the fuel pressure within the control chamber 46, thus movement of both of the valve needles is dependent upon the pressure differential between the upper and lower surfaces thereof, the effective cross sectional areas exposed to the fuel under pressure and the effect of spring biasing. In the arrangement illustrated in FIGS. 3 and 4, the inner valve needle 30 is not spring biased, the only spring biasing being by way of a spring 78 which is engaged between the piston 76 and a shim 80 which engages a shoulder defined by the bore 28. The spring 78 serves to maintain the outer valve needle 14 in engagement with the seating when fuel under pressure is not being supplied to the injector.

In use, initially the piston 76 is urged by the piezoelectric actuator towards a position in which the fuel pressure within the control chamber 46 is maintained at a high level. The application of high pressure to the control chamber 46 maintains the inner and outer valve needles 30, 14 in engagement with the seating against the action of fuel under pressure within the chamber 20. In order to commence injection, the piezoelectric actuator is energized to permit movement of the piston 76 to reduce the fuel pressure within the control chamber 46, and as a result the outer valve needle 14 moves to permit fuel delivery through the first group of outlet openings 16. This movement occurs against the action of the spring 78, and results from the pressure differential between the upper and lower surfaces of the valve needle 14 and the effective areas to which fuel under pressure is applied.

Once the outer valve needle 14 has lifted, fuel under pressure is applied to the inner valve needle 30. If the piston 76 is moved to reduce the pressure within the control chamber 46 relative to that applied to the lower part of the needle 30, the inner valve needle 30 is able to move against the action of the fuel pressure within the control chamber 46 to permit fuel delivery through both the first group of outlet openings 16 and the second group of outlet openings 32.

Termination of injection occurs by energizing the piezoelectric actuator to move the piston 76 to increase the fuel pressure within the control chamber 46. As a result, the fuel pressure applied to the inner and outer valve needles 30, 14 increases, and a point will be reached beyond which the fuel pressure within the control chamber 46 is sufficient to cause the valve needles 14, 30 to return into engagement with their respective seatings.

As described hereinbefore, the embodiment of FIGS. 3 and 4 requires the provision of only a single actuator to control movement of the inner and outer valve needles 30, 14 and leakage of fuel between the inner and outer valve needles 30, 14 is restricted by the application of fuel under pressure to the recess 34 provided in the upper part of the inner valve needle 30 deforming the inner valve needle 30 to form a substantially fluid tight seal with the outer valve needle 14.

Figure 5:
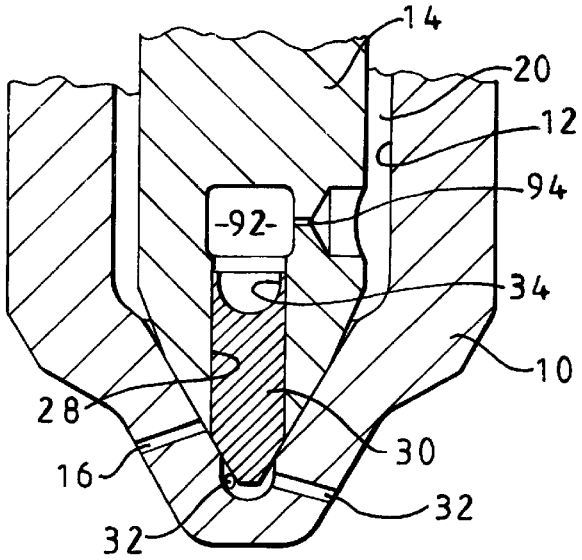
FIG. 5 is a view similar to FIG. 2 illustrating a further embodiment.

FIG. 5 illustrates an arrangement in which an inner needle 30 is slidable within a blind bore 28 formed in the outer needle 14. The inner needle 30 and bore 28 together define a chamber 92 which communicates, through a restricted passage 94 with a part of the bore 12 upstream of the first group of outlet openings 16.

In use, an appropriate actuator is used to control movement of the outer needle 14. If the outer needle 14 moves slowly, the fuel is able to flow at a sufficiently high rate through the passage 94 to the chamber 92 to ensure that the inner needle 30 remains seated. However, if the outer needle 14 moves quickly, the fuel pressure within the chamber 92 will fall as fuel is unable to flow to the chamber 92 at a sufficient rate to maintain the fuel pressure within the chamber, and the inner needle 30 will lift away from its seating. During injection, as fuel can continue to flow, at a low rate, to the chamber 92, the inner needle 30 will gradually move towards its seating.

As described hereinbefore, the inner needle 30 is provided with a recess 34 such that the application of fuel under pressure to the chamber 92 causes dilation of the inner needle 30 to improve the seal between the inner needle 30 and the bore 28, thus reducing fuel leakage.

What is claimed is:

1. A fuel injector comprising an outer valve needle, an inner valve needle slidable within a bore formed in the outer valve needle, an inner end of the inner valve needle being located within the bore, the inner end of the inner valve needle being provided with a recess whereby the application of fuel under pressure to the bore deforms the inner valve needle to form a substantially fluid tight seal between the inner and outer valve needles, wherein the inner and outer needles are exposed to the fuel pressure within a common control chamber, wherein the control chamber is arranged such that fuel pressure within the control chamber applies a force to the inner and outer valve needles which serves to urge the inner and outer valve needles against a seating.

2. A fuel injector as claimed in claim 1, wherein the inner needle is spring biased towards a seating.

3. A fuel injector as claimed in claim 1, a single actuator arrangement being used to control the fuel pressure within the control chamber.

4. A fuel injector as claimed in claim 3, wherein the actuator arrangement comprises an electromagnetically actuable valve.

5. A fuel injector as claimed in claim 3, wherein the actuator arrangement comprises a piezoelectric actuator arranged to control the position occupied by a piston to control the pressure within the control chamber.

6. A fuel injector as claimed in claim 1, wherein the bore formed in the outer needle is a blind bore, the blind bore and inner needle together defining a chamber which communicates through a restricted passage with a source of fuel under pressure.

7. A fuel injector as claimed in claim 6, further comprising an actuator arrangement associated with the outer needle and arranged to control the rate at which the outer needle is moved in use.

8. A fuel injector comprising an outer valve needle and an inner valve needle, the inner needle being slidable within a bore formed in the outer needle, the inner and outer valve needles being engageable with a seating to control fuel injection though first and second outlet openings respectively, the inner and outer valve needles being exposed to the fuel pressure within a control chamber, wherein the control chamber is arranged such that fuel pressure within the control chamber applies a force to the inner and outer valve needles which serves to urge the inner and outer valve needles against the seating, the fuel injector further comprising a single actuator arrangement controlling the fuel pressure within the control chamber.

9. A fuel injector as claimed in claim 8, wherein the actuator arrangement comprises an electromagnetically actuated valve.

10. A fuel injector as claimed in claim 8, wherein the actuator arrangement comprises a piston arranged to be moved by a piezoelectric actuator.

11. A fuel injector as claimed in claim 8, wherein the control chamber is defined, in part, by an end surface of the outer valve needle.

12. A fuel injector as claimed in claim 8, comprising a nozzle body provided with a nozzle body bore within which the outer valve needle is slidable, the nozzle body being in abutment with a housing, wherein the control chamber is defined, in part, by a recess provided in the housing.

13. A fuel injector as claimed in claim 8, wherein an inner end of the inner valve needle is located within the bore formed in the outer valve needle, wherein a surface of the inner end region of the inner valve needle is exposed to fuel pressure within the control chamber.

* * * * *